US006671919B2

(12) United States Patent
Davis

(10) Patent No.: US 6,671,919 B2
(45) Date of Patent: Jan. 6, 2004

(54) "AIR CUSHION EFFECT" SOFT ORAL CARE BRUSH

(76) Inventor: Colin G. Davis, 47-416 Lulani St., Kaneohe, HI (US) 96744

( * ) Notice: Subject to any disclaimer, the term of this patent is extended or adjusted under 35 U.S.C. 154(b) by 0 days.

(21) Appl. No.: 10/389,863

(22) Filed: Mar. 14, 2003

(65) Prior Publication Data

US 2003/0172483 A1 Sep. 18, 2003

Related U.S. Application Data

(63) Continuation-in-part of application No. 09/954,316, filed on Sep. 11, 2001, now abandoned.

(51) Int. Cl.[7] ..... A46B 9/04

(52) U.S. Cl. ..... 15/167.1; 15/106; 15/145; 15/176.1; 601/141

(58) Field of Search ..... 15/106, 145, 167.1, 15/167.2, 176.1, 176.6, DIG. 5, DIG. 6; 601/141

(56) References Cited

U.S. PATENT DOCUMENTS

| | | | | |
|---|---|---|---|---|
| 1,887,913 A | * | 11/1932 | Bell | 15/145 X |
| 2,558,332 A | * | 6/1951 | Artale | 15/167.1 |
| 4,598,437 A | * | 7/1986 | Ernest et al. | 15/176.1 |
| 4,731,896 A | * | 3/1988 | de La Tour | 15/106 |
| 5,148,657 | * | 9/1992 | Stafford et al. | 15/167.2 X |
| D341,254 | * | 11/1993 | Knox et al. | D4/106 |
| 5,342,284 | * | 8/1994 | Lemon et al. | 601/141 |
| 5,581,838 | * | 12/1996 | Rocco | 15/167.1 X |
| 6,067,684 | * | 5/2000 | Kweon | 15/167.1 |
| 6,079,075 | * | 6/2000 | Velez-Juan | 15/167.1 |
| 6,151,745 | * | 11/2000 | Roberts et al. | 15/167.1 |
| 6,192,544 | * | 2/2001 | Persidsky et al. | 15/167.1 |

FOREIGN PATENT DOCUMENTS

| | | | | |
|---|---|---|---|---|
| AT | 190899 | * | 7/1957 | 15/176.1 |
| DE | 2014278 | * | 10/1971 | 15/176.1 |
| DE | 3440395 | * | 5/1986 | 15/106 |
| EP | 285121 | * | 10/1988 | 15/167.1 |
| FR | 552210 | * | 11/1925 | 15/145 |
| FR | 2676166 | * | 11/1992 | 15/167.2 |
| SU | 1708283 | * | 1/1992 | 15/167.1 |

* cited by examiner

*Primary Examiner*—Mark Spisich
(74) *Attorney, Agent, or Firm*—Brown Martin Haller & McClain LLP

(57) ABSTRACT

A oral care brush device is described for use primarily for massaging and stimulation of sensitive gums and teeth. The brush head is hollow but closed at one end, and is made of a shape-retaining but soft and resilient material. One end of the brush handle is inserted into the hollow handle and is configured to substantially seal the open end of the head and trap air inside, the trapped air providing an air cushion effect. The air cushion effect and the soft head allow use of the device for effective and thorough cleaning, massage and stimulation of the gums and teeth notwithstanding the user's tooth or gum sensitivity.

15 Claims, 2 Drawing Sheets

"AIR CUSHION EFFECT" SOFT ORAL CARE BRUSH

CROSS-REFERENCE TO RELATED APPLICATION

This application is a continuation-in-part of application Ser. No. 09/954,316, filed Sep. 11, 2001, entitled "Oral Care Brush", abandoned.

BACKGROUND OF THE INVENTION

1. Field of the Invention

This invention relates to an oral care brush for use primarily as a gum massage brush and which also functions as a toothbrush.

2. Description of Background Technology

Natural bristle toothbrushes, primarily using bristles from swine, have been in use for over a century. The first nylon toothbrushes were made in 1938. The use of nylon filaments gained widespread acceptance because of the wars and other world disturbances that interfered with the importation of good natural bristles. Today, the combination of nylon bristles with plastic handles is commonly used by manufacturers. Over the past ten years, dentists have come to favor soft elastomeric bristles over hard nylon bristles as the hard bristles can cause gum trauma. However, the toothbrush handles (including the bristle base portion) are still commonly made of relatively hard plastic.

The use of gum brushes has also been instrumental in fighting periodontal disease including gingivitis and periodontitis. Such chronic bacterial infections can affect both the gums and the bone supporting the teeth. Gum brushes aid in the maintaining of good oral health by massaging and stimulating gum tissue and not allowing plaque to spread and grow below a person's gum line. They allow for toxins that are produced by bacteria in plaque to be brushed away rather than irritate the gums. With proper brushing and massage, blood flow is stimulated and the toxins in a person's mouth do not initiate a chronic inflammatory response in which the tissues and bone that support the teeth are broken down and destroyed.

Typical toothbrushes and gum brushes usually have an elongated handle wherein orthogonal bristles extend or protrude from one end of the handle. The problem with this configuration is that because the bristles are attached directly to the handle, which is made of relatively hard material, people with sensitive gums have to be careful using these brushes and insuring that the non-bristle portion does not touch or hurt them. This is not easy for many people to do, and therefore the gums are often subjected to impact from the hard brush handle.

A satisfactory gum massage/tooth cleaning brush must also be comfortable and allow for a thorough cleaning of the teeth and massaging of the gums. It is important for a user to be able to apply pastes, ointments and oils onto a brush head in a manner that allows for maximum application to the desired area. Therefore, there is a need for an oral care brush that is comfortable and efficient for maintaining good oral hygiene.

SUMMARY OF THE INVENTION

The present invention provides a new and improved oral care brush that allows for effective massaging and stimulating of the gums and cleaning the teeth of a user, while also preventing deleterious impact of hard material on the gums. The present brush thus provides for effective oral care for persons with sensitive or diseased gums by avoiding aggravating trauma to the gums by the impacts of hard components of prior art brushes.

The present invention is an oral care brush which has a elongated handle to be held by the user and a brush head. The brush head has soft bristles protruding from the outside of the head in the normal brush configuration. The head has an elongated hollow structure, with a hollow interior formed by its side, top and bottom walls. The end of the head distal from the handle is closed, while the end proximal to the handle is open. The end of the handle adjacent the head is configured to fit into the hollow interior of the head through the open end and be retained in that configuration during use. The head is made of a relatively soft material, preferably an elastomeric material such as a silicone polymer. The end of the handle which is received into the hollow head is formed such that it has a sealing function so that air is trapped within the hollow head when the brush handle is inserted into the head. This trapped air acts as an air cushion during use of the brush, such that movements of the handle by the user which would otherwise be transmitted directly to the outer surface of the brush head and thence to the gums and teeth are cushioned by the air, thus reducing the degree of impact of the head upon the gums or teeth. This air cushion effect, combined with the critical softness of the head material, allows the present invention to be used easily, comfortably and effectively by users with gums and teeth sensitivity and disease problems who cannot effectively use prior art brushes or who in the more aggravated situations may not even be able to tolerate use of prior art brushes.

More particularly, the present invention is an oral care brush which has an elongated handle having opposite first and second ends; and a brush head having an open first end and an opposite closed second end, a top and bottom face with a plurality of bristles extending orthogonally from both said top and bottom faces, and a hollow interior for releasably receiving said first end of said handle through said open first end of said head, with the head being composed of a material which is substantially shape-retaining but which is soft and resilient, said first end of said handle being structured such that upon receipt thereof in said hollow interior of said brush head, it cooperates with interior surfaces and said closed second end of said head to entrap a volume of air in said hollow interior of said head; whereby when said oral care brush is used for brushing of teeth or gums, said entrapped volume of air acts as an air cushion and moderates relative movement of said handle and said head, such that in combination with said soft and resilient material composing said head, a user obtains effective massaging and stimulation of the gums in conjunction with effective brushing of the teeth without suffering stress imposed upon the gums.

The brush head has a top face and a bottom face with multiple bristles that extend orthogonally from both of the faces. In the present invention it is critical that the brush head be made of silicone or other soft elastomeric material, and not nylon or other hard polymeric materials in the manner of prior art toothbrushes or gum brushes. Typically the head will be formed as an elongated generally rectangular box, closed at one end as will be illustrated below, but other elongated shapes such as circular or polygonal cylinders can also be used. The exterior bristles will be placed on the outer surface of the head in the appropriate configuration to obtain the cleaning and massaging effect that it is desired to achieve.

A critical feature of the invention is the establishment of an air cushion within the head, to moderate the forces imposed on the brush by the user manipulating the handle which would otherwise be transmitted directly to the user's gums and teeth. This reduces the traumatic effect of what would be an unmoderated impact on the gums or teeth, which could have a deleterious effect on the gums or teeth, including the likelihood that such unmoderated impact will aggravate a previously existing gum or tooth sensitivity or disease.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION AND PREFERRED EMBODIMENTS

Figure 1:
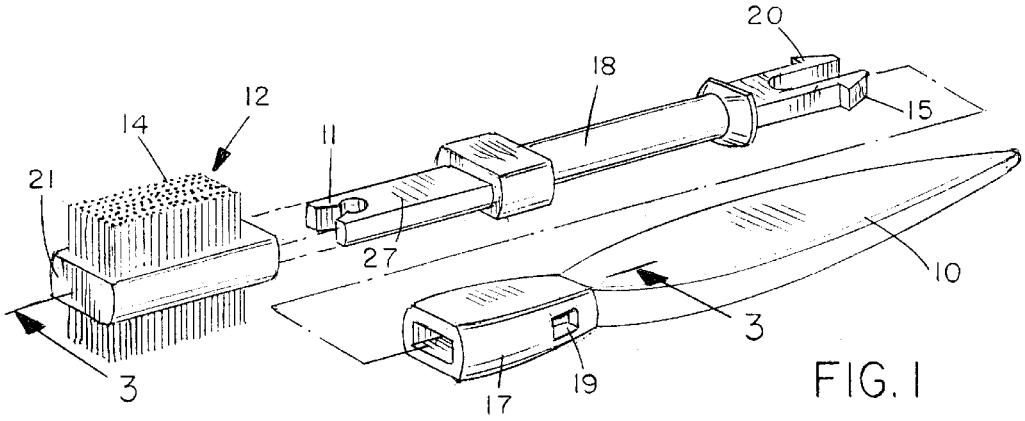
FIG. 1 is an exploded perspective view of an embodiment of the device.
Figure 2:
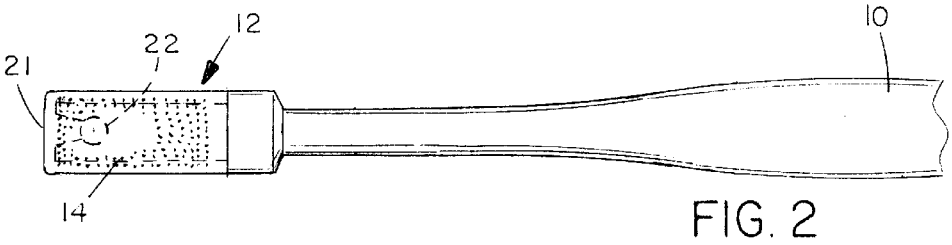
FIG. 2 is a top view of another embodiment of the device.

The invention is best understood by reference to the several Figures of the drawings. FIGS. 1–5 illustrate two embodiments of the device showing principal components, and which in the FIG. 1 embodiment also illustrates the optional aspect of having a two-section handle, the purpose of which will be described below. An elongated handle 10 (which may include an extension section 18) has a top and bottom face and opposite first and second ends, the first end 27 being proximal to the brush head 12 and the second end being distal to the brush head 12. The proximal first end 27 includes, in this embodiment, a releasable attachment slot 11 in the leading edge of the first end of the handle. The handle 10 can be any shape that provides for ease of use while a user is holding the device. A few examples of possible shapes for the handle include rectangular, oblong, or cylindrical. When there is an extension 18 as part of handle 10, it can conveniently be connected by coupling assembly 20 which has flexible prongs with protrusions 15 which fit into an enlarged member 17 and engage slots 19, thus securing together the extension 18 and the remainder of the handle to form the unitary handle structure 10. The extension member is optional; when it is not present the handle-engaging proximal first end portion 27 will be part of the handle 10 directly, as illustrated in FIG. 2. In most cases use of the extension 18 is not preferred, but it is useful when it is desired to a single handle be used with two or more brush heads 12.

Figure 3:
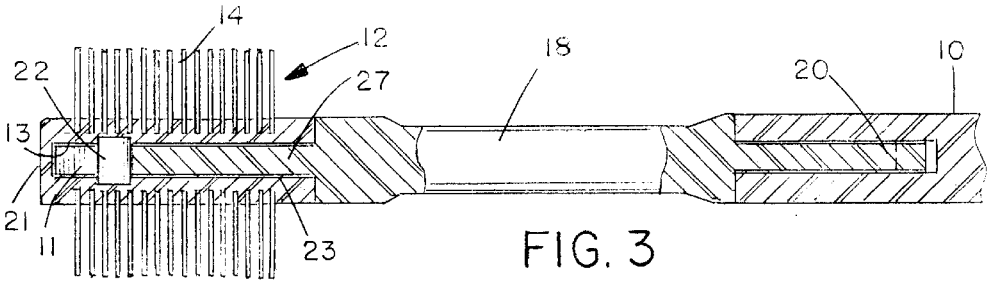
FIG. 3 is an enlarged sectional view taken on line 3—3 of FIG. 1 of the device as assembled.
Figure 4:
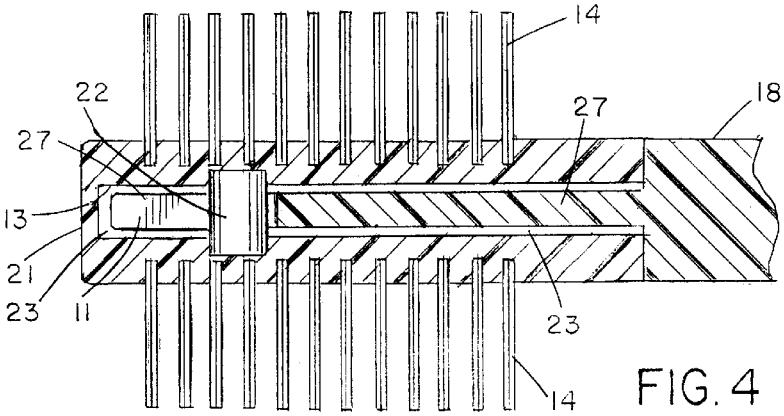
FIG. 4 is a cross-sectional elevation view of a portion of the brush head portion of the device of FIG. 3.
Figure 5:
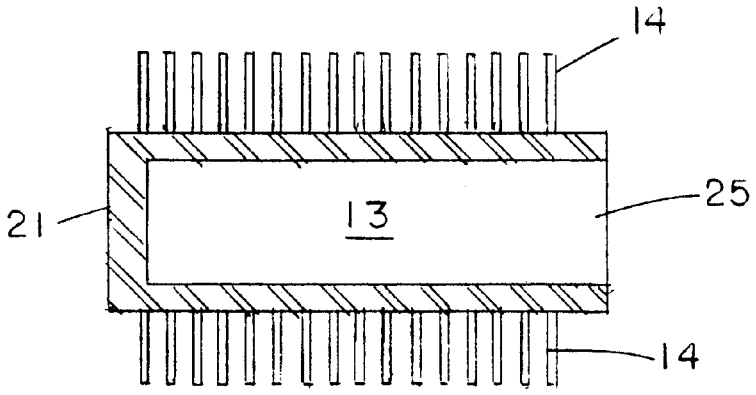
FIG. 5 is a cross-section elevation view of the head without having the handle received therein.

The brush head 12 is releasably attached to proximal first end of the handle 10. The brush head 12 is hollow and has first and second ends and top, bottom and side faces. Extending orthogonally from both the top and bottom faces of the brush head 12 are a plurality of bristles 14. In the embodiment of FIGS. 1 and 3 the brush head 12 is attached to the handle 10 by a snap-fit engagement of slot 11 with post 22, the latter being disposed within the hollow interior 13 of the head 12.

The hollow interior 13 of the head 12 is formed by the ends and faces. The distal end 21 is closed, but the proximal end 25 is open. The attachment of the brush head 12 to the proximal end 27 of the handle 10 (either directly or through extension member 18) defines a gap 23 between the two. The structure of the proximal end 27 of the handle 10 is such that it abuts the open end 25 of the handle, substantially sealing the opening and thus trapping some air in the gap 23 of the interior 13. This trapped air in the gap 23 provides an air cushioning effect when the brush is used by a user. In effect the air cushioning acts to moderate the rapidity of the movements of the handle 10 caused by the user's hand movement, working in the manner of a dashpot or a shock absorber. This is advantageous because such an air cushioning effect in gap 23 makes the contacts of the brush head 12 against the gums and teeth softer and gentler, which helps avoid discomfort, trauma or aggravation of sensitivity or disease to the user while brushing.

Figure 6:
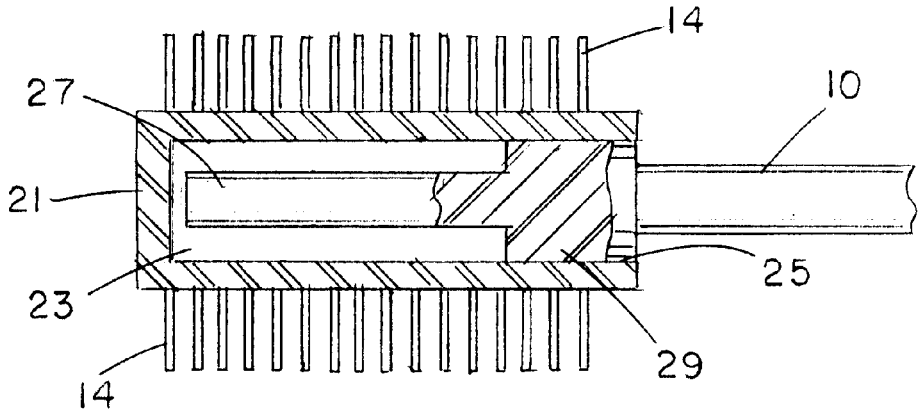
FIGS. 6 and 7 are views similar to that of FIGS. 3 and 4 but illustrating alternative configurations for the received portion of the handle.
Figure 7:
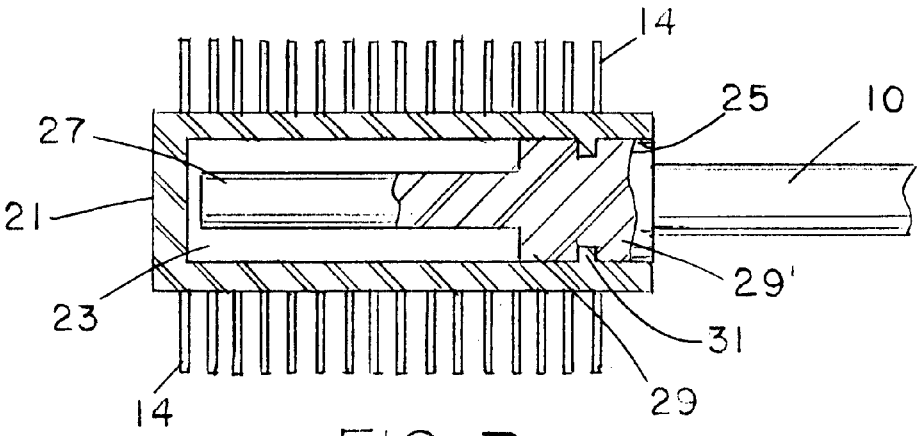

FIGS. 6 and 7 show different embodiments of the proximal end 27 of the handle 10 for creation of the air gap 23 in the interior 13 of the handle. In the embodiment of FIG. 6 there is a peripheral flange 29 around the outer surface of the end 27 adjacent the open end 25 of the head 12. This acts to form an "air seal" which traps the air in gap 23 and also, because of its frictional engagement of the interior surfaces of the walls of head 12, provides releasable connection between the handle 10 and the head 12 without the need for the snap-fit connector of members 11 and 22. In the embodiment of FIG. 7 there are two flanges 29 and 29' which engage an internal protrusion 31 from the interior wall surfaces of head 12. These dual flanges function in the same manner as flange 29 in FIG. 6 as to the air seal, but the engagement of the flanges 29 and 29' with protrusion 31 enhances the releasable connection function against unintended separation of the handle 10 and the head 12.

Preferably the bristles 14 will be of a length shorter than typical toothbrush head bristles to be suitable for the application of oils, pastes, ointments or the like to the gums for cleaning or massaging or for the purpose of topical treatment of undue sensitivity or gum disease. The range of lengths of the toothbrush bristles is preferably from 2 mm to 5 mm. Because the lengths of the bristles are not necessarily what is considered to be standard, and the bristles are made of silicone or other -similar soft material, the bristles provide features not previously available. The composition and length of the bristles allows for them to bend directly at their point of attachment. This means that when any substance is applied to the bristles, even though it may fall to the bottom of the brush head, it can still be applied directly onto either the teeth or gums. This was not possible with prior toothbrushes because the paste or oil applied would fall through the bristles and settle onto the face of the toothbrush and would not reach the gums. Additionally, depending on the composition of the bristles, the degree to which the brush functions as a more vigorous tooth brushing implement can vary. With the selection of certain harder bristles, the brush can be better used for the removal of plaque. On the other hand, with the incorporation of softer bristles, use of the brush for more sensitive users is achieved. It should be recognized, however, that the principal function of the brush is to provide for effective gum massaging and stimulation for users, especially users with sensitivity in their gums (either natural or due to disease, dysfunction or injury). Consequently it should be recognized that the range of degree fo vigor of tooth brushing in limited and will not extend to a high degree of vigor which is detrimental to gum function or condition. With the soft head and bristles is it not intended that the device of this invention be used primarily for "vigorous" toothbrushing.

Thus the device of the present invention allows for increased comfort and efficiency when used by an average person or even a person with sensitive teeth or gums. Because the bristles of the brush head are made of silicone instead of traditional materials such as nylon, the pressure on a person's teeth or gums is reduced and the bristles are more flexible. The silicone provides for softer application by the user and for more comfort while in use. The regular nylon bristles are not as flexible when they are in this length range and also require more bristles to be contained on the brush head. Therefore, any paste, ointment or oil applied to the these bristles will simply remain at the bottom of the brush head and will not be able to be appropriately applied to the gums or teeth of the user. The brush head can be used for massaging and stimulating the gums of the user, but may also be used as an applicator for thin paste, oil, or the like. Also, the lengths of the bristles and the fact that they are made of silicone allows for the bristles to be positioned in a less densely packed configuration. This configuration allows for use and enjoyment by a greater number of people. For example, a user with no special needs or problems can use the brush head, but additionally a person with particularly sensitive teeth or gums will find the brush head more comfortable.

Another advantage is that because the brush head is two-sided, it allows for easier use of the brush without requiring that it be turned around. It also allows a user to apply paste or oil on both sides of the toothbrush in order to increase efficiency. A user may apply the paste or oil on one side only or use two different pastes, gels, etc. This may be useful in some applications and cuts down on brushing or massaging time required because two different functions are performed at once.

Another advantage of the present invention is that because the brush head is a separate unit that engages with the shaft, the bristles contained on the brush head are never in direct contact with the handle as is common with other toothbrushes. This configuration allows for greater flexibility with the brush head and allows the bristles to bend at their point of connection. This is not easily done with the prior toothbrushes because when the bristles are attached to the handle itself, they do not bend as easily at the point of connection.

Another advantage is that the brush head 12 is releasably attached to the handle 10, enabling the brush head and the handle are separately replaceable. The fact that each part may be replaced at different times cuts down both on replacement costs, and also the number of replacement parts that are thrown away.

Still another advantage is that the hard plastic end portion of the handle 10 which enters the oral cavity will be substantially covered by the soft brush head 12. This means that the gums and teeth of the user are protected from being touched by the hardened material which could otherwise cause discomfort.

Although an exemplary embodiment of the invention has been described above by way of example only, it will be understood by those skilled in the field that modifications may be made to the disclosed embodiment without departing from the scope of the invention, which is defined by the appended claims.

I claim:

1. An oral care brush comprising:

an elongated handle having opposite first and second ends; and a brush head having a closed first end and an opposite open second end, at least one-peripheral face with a plurality of bristles extending orthogonally therefrom, and a hollow interior for releasably receiving said first end of said handle through said open second end of said head, with the head being composed of a material which is substantially shape-retaining but which is soft and resilient, said first end of said handle being structured such that upon receipt thereof in said hollow interior of said brush head, it cooperates with an inner surface and said closed first end of said head to entrap a volume of air in said hollow interior of said head;

whereby when said oral care brush is used for brushing of teeth or gums or both, said entrapped volume of air acts as an air cushion and moderates relative movement of said handle and said head, such that in combination with said soft and resilient material composing said head, a user obtains effective massaging and stimulation of the gums in conjunction with effective brushing of the teeth without suffering stress imposed upon the gums.

2. An oral care brush as claimed in claim 1 wherein said first end of said handle comprises an outer surface at least a portion of which contacts said head at or interiorly of said open second end such that flow of said entrapped air out through said open second end of said head is substantially prevented.

3. An oral care brush as claimed in claim 2 wherein said first end of said handle comprises a flange extending therefrom and,disposed adjacent to said first end of said handle, with a peripheral edge of said flange resiliently contacting said inner surface of said hollow interior when said first end of said handle is received in said hollow interior of said head, such that flow of said entrapped air out through said open second end of said head is prevented.

4. An oral care brush as claimed in claim 3 further comprising a plurality of said flanges disposed axially on said handle and substantially adjacent to said first end thereof, each having a peripheral edge in contact with said inner surface of said hollow interior of said head when said first end of said handle is received in said hollow interior of said head, such that flow of said entrapped air out through said open second end of said head is prevented.

5. An oral care brush as claimed claim 1 wherein said shape-retaining soft and resilient material comprises an elastomeric material.

6. An oral care brush as claimed in claim 5 wherein said elastomeric material comprises a silicone polymer.

7. An oral care brush as claimed in claim 1 wherein said bristles are made of a soft elastomeric material.

8. An oral care brush as claimed in claim 7 wherein said elastomeric material comprises a silicone polymer.

9. An oral care brush as claimed in claim 7 wherein the bristles are between 2 mm and 5 mm in diameter.

10. An oral care brush as claimed in claim 1 wherein said brush head has disposed in said hollow interior a first locking member which cooperates with a second locking member on said first end of said handle for releasable attachment of said head to the handle.

11. An oral care brush as claimed in claim 10 wherein said first locking member comprises a post extending across said hollow interior of said head laterally to a longitudinal axis of said head and said second locking member comprises a recess in said first end of said handle which engages said post when said first end of said handle is received in said hollow interior of said head.

12. An oral care brush as claimed in claim 1 comprising bristles of different lengths.

13. An oral care brush as claimed in claim 1 wherein the handle comprises an elongated extension member and a grip member with the extension member disposed between the head and the grip member, said extension member including said first handle end and said extension member being releasably attached to said head and said grip member.

14. An oral care brush as claimed in claim 1 wherein said handle has an outer surface configured to accommodate the grip of the hand of a user of the brush.

15. An oral care brush as in claim 1 wherein said handle is formed of material harder than the material of said brush headland that portion of said handle which enters the oral cavity during use of the brush is substantially covered by the softer material of said brush head, such that user discomfort is avoided by the gums and teeth of the user thereby being protected from being other than incidently touched by the harder material.

* * * * *